US011180225B2

(12) United States Patent
Van Ittersum

(10) Patent No.: US 11,180,225 B2
(45) Date of Patent: Nov. 23, 2021

(54) WATER SUPPLY AND STORAGE SYSTEM FOR WATER VESSEL

(71) Applicant: Jason Van Ittersum, Spring Lake, MI (US)

(72) Inventor: Jason Van Ittersum, Spring Lake, MI (US)

( * ) Notice: Subject to any disclaimer, the term of this patent is extended or adjusted under 35 U.S.C. 154(b) by 136 days.

(21) Appl. No.: 16/589,708

(22) Filed: Oct. 1, 2019

(65) Prior Publication Data

US 2020/0172205 A1 Jun. 4, 2020

Related U.S. Application Data

(60) Provisional application No. 62/774,544, filed on Dec. 3, 2018.

(51) Int. Cl.

| | |
|---|---|
| ***B63B 34/00*** | (2020.01) |
| ***B63B 29/04*** | (2006.01) |
| ***B63B 29/00*** | (2006.01) |

(52) U.S. Cl.

CPC ..... *B63B 34/00* (2020.02); *B63B 29/00* (2013.01); *B63B 29/04* (2013.01); *B63B 2029/043* (2013.01)

(58) Field of Classification Search

CPC ..... B63B 34/00; B63B 29/00; B63B 29/04; B63B 2029/043

See application file for complete search history.

(56) References Cited

U.S. PATENT DOCUMENTS

| | | | | |
|---|---|---|---|---|
| 2,920,469 | A * | 1/1960 | Henshaw, Jr. | D06F 33/00 68/12.13 |
| 3,594,825 | A | 7/1971 | Reid et al. | |
| 3,773,432 | A * | 11/1973 | Chow | F04D 29/506 415/206 |
| 4,837,870 | A | 6/1989 | Wiley | |
| 5,209,177 | A | 5/1993 | Granie et al. | |
| 5,403,498 | A | 4/1995 | Morrissey et al. | |
| 6,672,240 | B1 | 1/2004 | Abe et al. | |
| 7,032,258 | B2 | 4/2006 | O'Hanlon | |
| 8,997,679 | B2 | 4/2015 | Ricci | |
| 9,993,387 | B2 * | 6/2018 | Hatley | A61H 33/60 |
| 2004/0031430 | A1 | 2/2004 | Aube et al. | |
| 2005/0166313 | A1 | 8/2005 | Permenter | |
| 2008/0245319 | A1 | 10/2008 | Toyoshima et al. | |
| 2014/0053769 | A1 | 2/2014 | Karpenske | |
| 2014/0137782 | A1 * | 5/2014 | Cho | B63B 3/68 114/72 |
| 2015/0203178 | A1 | 7/2015 | Karpenske | |

* cited by examiner

*Primary Examiner* — Stephen P Avila

(74) *Attorney, Agent, or Firm* — Price Heneveld LLP

(57) ABSTRACT

A water vessel includes a deck having an upper surface and a lower surface. First and second hulls are spaced-apart from one another and operably coupled to the lower surface of the deck. At least one of the first and second hulls has an at least partially hollow interior. A storage tank is positioned within the at least partially hollow interior of at least one of the first and second hulls. A tub for holding water is supported by the deck. The tub includes an interior cavity having a capacity and is fluidically coupled to the storage tank. The storage tank has a capacity less than the capacity of the tub. A pump system is configured to direct water between the tub and the storage tank and at least partially fill the capacity of the tub.

16 Claims, 5 Drawing Sheets

WATER SUPPLY AND STORAGE SYSTEM FOR WATER VESSEL

CROSS-REFERENCE TO RELATED APPLICATIONS

This application claims priority to U.S. Provisional Application No. 62/774,544, filed on Dec. 3, 2018 entitled, "WATER SUPPLY AND STORAGE SYSTEM FOR WATER VESSEL," the disclosure to which is hereby incorporated herein by reference in its entirety.

FIELD OF THE DISCLOSURE

The present device generally relates to a water supply and storage system for a water vessel, and more specifically, to a tub for holding water positioned on a water vessel.

BACKGROUND OF THE DISCLOSURE

Generally, water vessels do not include a tub for holding water that can further accommodate occupants therein, where the tub is positioned on a deck of the water vessel. When water vessels do include such a tub, the water vessel is restricted to only traveling on calm waters to prevent water from spilling over an outer edge of the tub. It can be difficult for the water vessel to travel without spilling water out of the tub, especially at increasing speeds. Additionally, the water level cannot easily be adjusted to accommodate varying numbers of occupants within the tub. When using conventional water vessels that include tubs for holding water, the water vessel must travel at a relatively slow speed to prevent water from spilling out of the tub and onto a top surface of the deck. Alternatively, the water level within the tub must be kept low so as to prevent the water from spilling over the top edge of the tub as the water vessel travels at higher speeds or in rough waters.

Thus, a water vessel is desired that allows for a water supply and storage system for a tub that allows a user to adjust a water level within the tub, such that the water vessel can travel at higher speeds while preventing water from spilling over the outer edge of the tub.

SUMMARY

In at least one aspect, a water vessel includes a deck having an upper surface and a lower surface. First and second hulls are spaced-apart from one another and operably coupled to the lower surface of the deck. At least one of the first and second hulls has an at least partially hollow interior. A storage tank is positioned within the at least partially hollow interior of at least one of the first and second hulls. A tub for holding water is supported by the deck. The tub includes an interior cavity having a capacity and is fluidically coupled to the storage tank. The storage tank has a capacity less than the capacity of the tub. A pump system is configured to direct water between the tub and the storage tank and at least partially fill the capacity of the tub.

In at least another aspect, a water vessel includes a closed hull structure and a deck supported by the closed hull structure. A tub for holding water is supported by the deck. A storage tank is fluidically coupled to the tub. A pump system is fluidically coupled to the tub and the storage tank. The pump system is configured to direct water between the tub and the storage tank. A drain system is fluidically coupled to the tub.

In at least another aspect, a hot tub assembly includes a tub for holding water. A bi-directional pump system is fluidically coupled to the tub. A storage tank is coupled to the tub via the bi-directional pump system. The bi-directional pump system is configured to direct water between an interior of the tub and the storage tank. A shell is positioned about a perimeter of the tub. The shell includes a drain system operably coupled to at least one of the storage tank and the tub.

These and other features, advantages, and objects of the present device will be further understood and appreciated by those skilled in the art upon studying the following specification, claims, and appended drawings.

DETAILED DESCRIPTION OF EMBODIMENTS

Figure 1A:
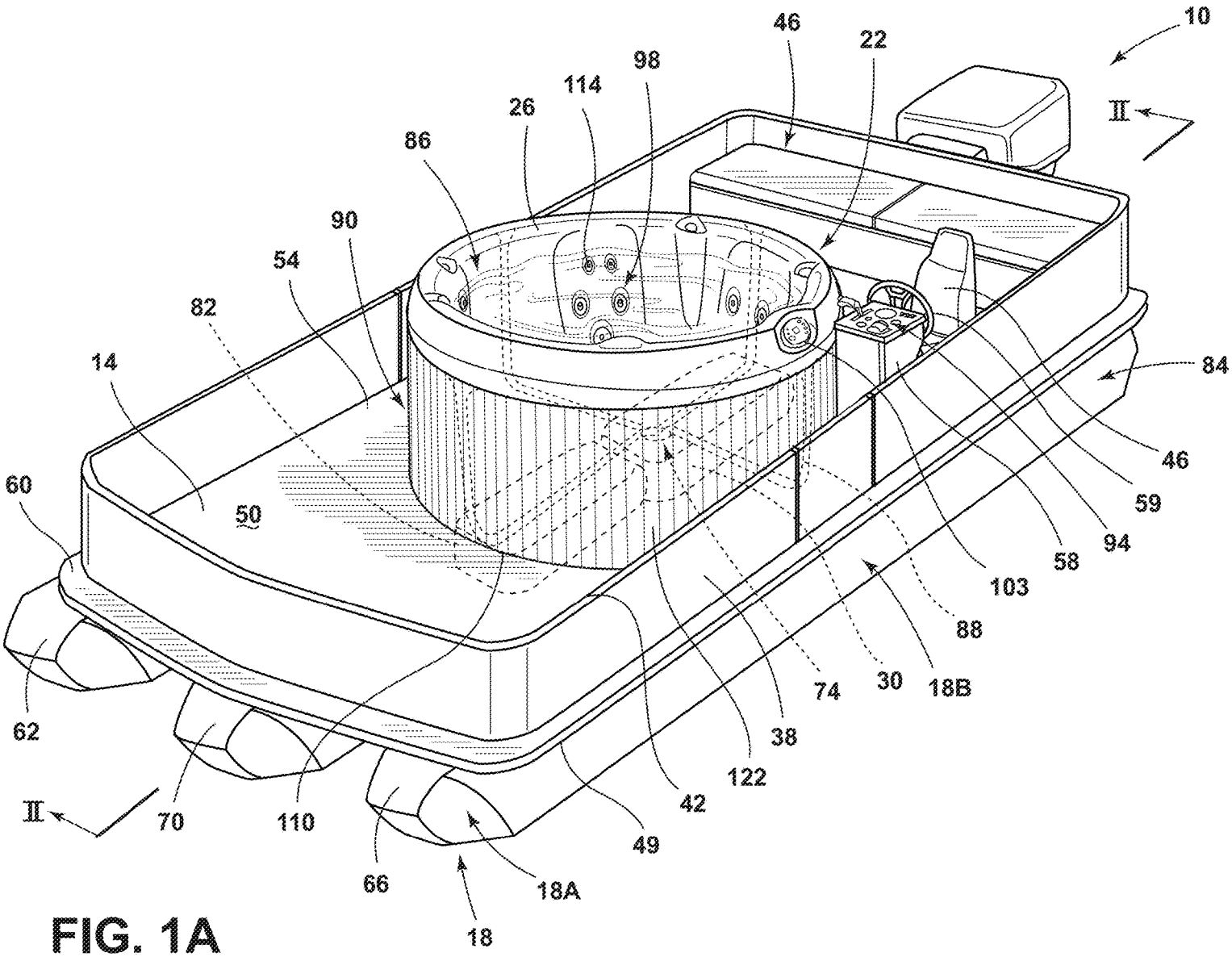
FIG. 1A is a front top perspective view of a water vessel having a tub and a storage tank housed within a closed hull structure and a helm station shown in a first position.

For purposes of description herein the terms "upper," "lower," "right," "left," "rear," "front," "vertical," "horizontal," and derivatives thereof shall relate to the device as oriented in FIG. 1A. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIGS. 1A-4, the reference numeral 10 generally designates a water vessel having a deck 14 coupled to a closed hull structure 18. The water vessel 10 includes a water system 22 having a tub 26 for holding water positioned on the deck 14 and a storage tank 30 fluidically coupled to the tub 26. The water system 22 may include a pump system 34 configured to move water between the tub 26 and the storage tank 30. In the depicted example, the water vessel 10 is a tri-toon pontoon-style boat. It will be understood that the depicted example of the water vessel 10 is only exemplary and the water vessel 10 will be understood to include other watercrafts and boats.

Figure 1B:
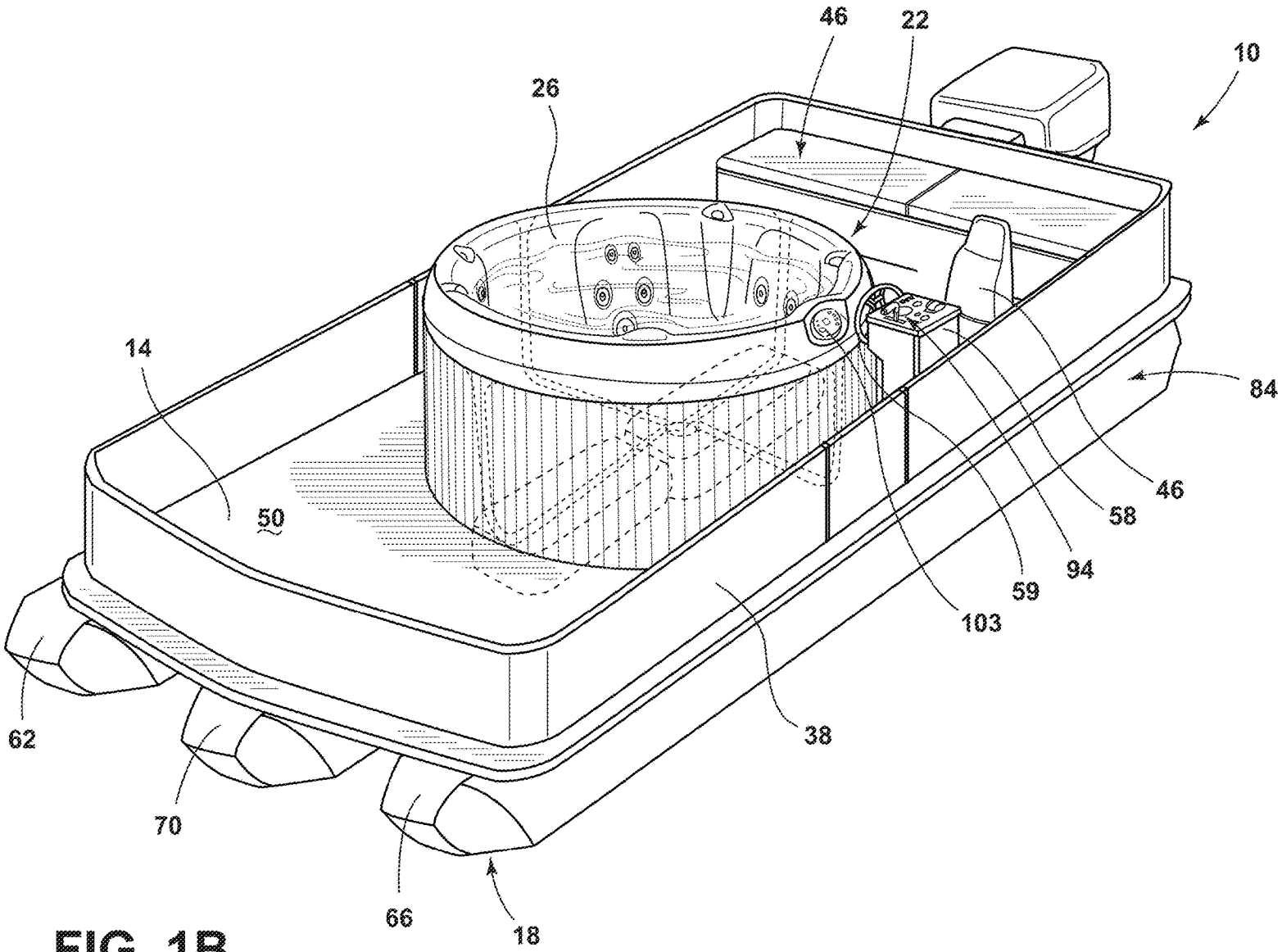
FIG. 1B is a front top perspective view of the water vessel of FIG. 1A showing the helm station in a second position.

Referring to FIGS. 1A and 1B, the water vessel 10 includes the deck 14 supported by the closed hull structure 18. The deck 14 may be a substantially planar surface that extends at least a portion of a length of the closed hull structure 18. The deck 14 can be formed from a single panel or at least two panels coupled together. The deck 14 may be formed from, for example, plastics, metals, metal alloys, fiberglass, and/or wood. The deck 14 may be positioned on and supported by the closed hull structure 18 from an underside 49 thereof, such that the deck 14 is spaced-apart from the support surface beneath the water vessel 10 (e.g., water or land).

A seating assembly 46 may be positioned on and/or coupled to a top surface 50 of the deck 14. The seating assembly 46 may be adjacent to an edge portion 54 of the deck 14. In various examples, the seating assembly 46 is positioned proximate a helm station 58. The seating assembly 46 may be operable between first and second positions on the deck 14 and/or coupled to a sidewall 38. In various examples, the water vessel 10 may include the sidewall 38 having a railing or gunwale 42. The sidewall 38 can extend upwards from the deck 14 at a uniform and/or varying heights proximate the edge portion 54 of the deck 14. The sidewall 38 may extend around a substantial portion of a perimeter 60 of the deck 14. The gunwale 42 can be configured to assist in stabilizing the water vessel 10 as the water vessel 10 moves. The gunwale 42 may provide a walkway about the perimeter 60 of the deck 14 for passengers on the water vessel 10.

The closed hull structure 18 may include one or more elongated hulls that extend at least a substantial portion of a length of the deck 14. In various examples, the closed hull structure 18 can have a substantially uniform cross-sectional measurement. In the depicted example, the closed hull structure 18 is a rounded shape and has a smaller cross-sectional measurement at end portions 18A compared to a center portion 18B. The end portion 18A can be a tapered portion to assist in maneuvering the water vessel 10 through water. In various examples, the closed hull structure 18 may be partially hollow. The closed hull structure 18 may be formed from, for example, metals, metal alloys, plastics, and/or fiberglass.

The closed hull structure 18 may include first, second, and/or third hulls 62, 66, 70. The first hull 62 can be positioned in a parallel, spaced-apart alignment relative to the second and/or third hulls 66, 70. The first and second hulls 62, 66 may be coupled to opposing edge portions 54 of the deck 14, and the third hull 70 can be positioned therebetween. In various examples, the closed hull structure 18 may include only the first and second hulls 62, 66, wherein the first and second hulls 62, 66 are approximately 36-inches in diameter. The first and second hulls 62, 66 may be approximately 25-feet in length. Other diameters and lengths are also considered suitable for use with the present concept. In the depicted example, the closed hull structure 18 can include an access point 74 to allow access to the storage tank 30 and/or a fuel tank 82 positioned in an interior 84 of the closed hull structure 18. The access point 74 may include an aperture disposed through the deck 14 that is a suitable size to accommodate a tubing structure 88 of the pump system 34. The access point 74 may be operable between closed and opened positions, such that the access point 74 can be in a closed position if the pump system 34 (FIG. 2) is not connected to the tub 26.

According to various examples, the water vessel 10 may include the fuel tank 82 positioned within the interior 84 of the closed hull structure 18. The fuel tank 82 can be positioned within the same closed hull structure 18 as the storage tank 30. In various examples, the fuel tank 82 may be positioned within the interior of a separate closed hull structure 18 compared to the storage tank 30, such that the fuel tank 82 can counteract the weight of the storage tank 30 and provide stability for the water vessel 10. In such examples where the fuel tank 82 is positioned within the interior 84 of the closed hull structure 18, the fuel tank 82 can be surrounded by and/or embedded in an insulation material 85, such that the fuel tank 82 is stabilized within the closed hull structure 18. The fuel tank 82 may also be positioned on and/or coupled to the deck 14.

Figure 4:
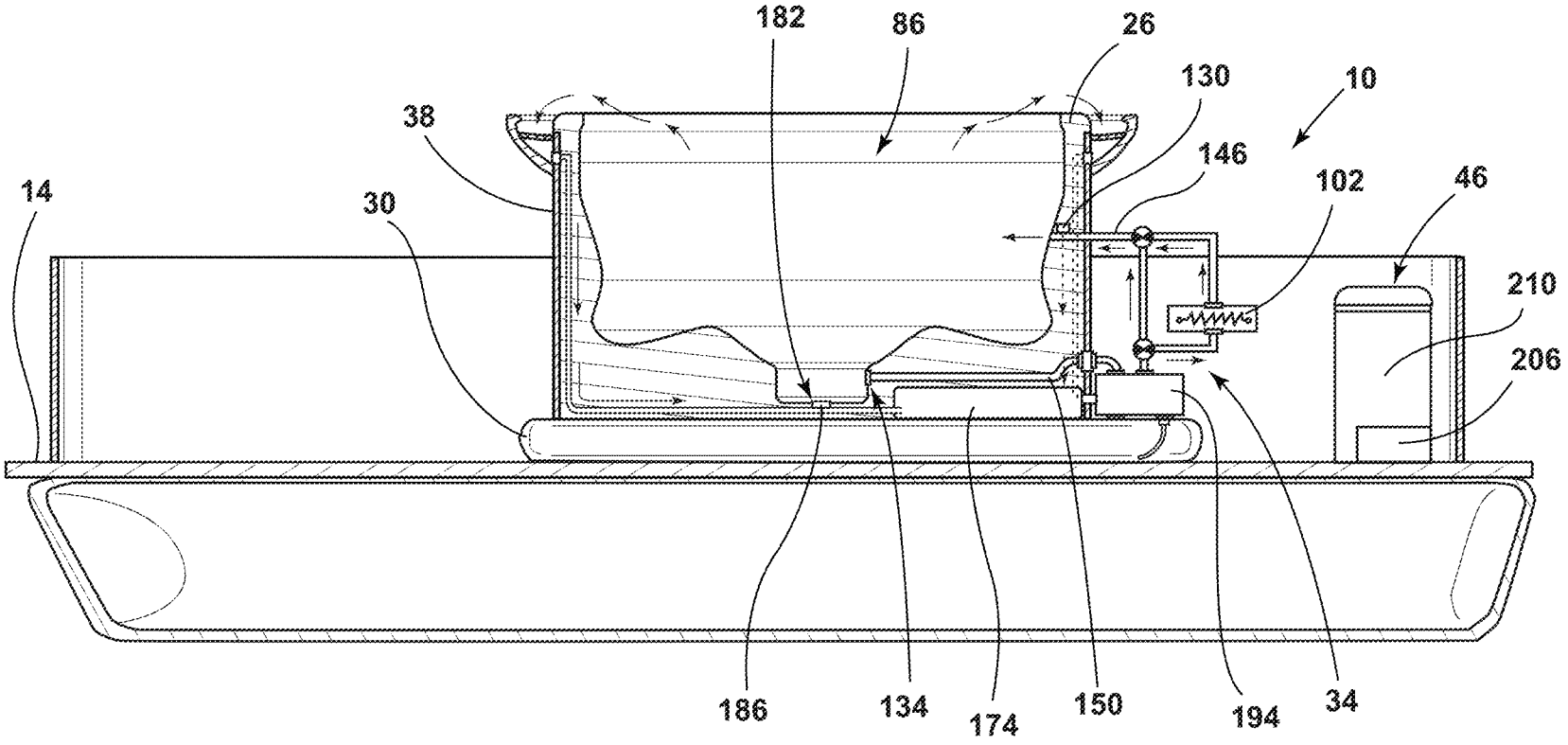
FIG. 4 is a cross-sectional view of the water vessel of FIG. 3 taken at line IV.

The helm station 58 may be operably coupled to the deck 14, such that the helm station 58 can be operable between first and second positions. In various examples, the helm station 58 may move from the edge portion 54 of the deck 14 towards a center portion 90 of the deck 14. The edge portion 54 where the helm station 58 is in the first position can be proximate a bow, stern, and/or lateral portion of the water vessel 10. The helm station 58 may be configured to rotate about a pivot point on the deck 14. The helm station 58 is contemplated to be positioned adjacent to the tub 26. In FIG. 1A, the helm station 58 is shown in a first position, wherein a steering wheel 59 thereof is aligned with the seating assembly 46, such that an operator of the water vessel 10 can steer the water vessel 10 from the seating assembly 46 when the helm station 58 is in the first position. In a second position, shown in FIG. 1B, the helm station 58 is shown with the steering wheel 59, and the other associated controls of the helm station 58, aligned with the tub 26, such that an operator of the water vessel 10 can steer the water vessel 10 from an interior 86 of the tub 26 when the helm station 58 has been moved from the first position (FIG. 1A) to the second position (FIG. 1B). In various examples, the helm station 58 can include a controller 94 operably coupled to at least one of a jet system 98 within the tub 26, the pump system 34 (FIG. 2), and/or a heater 102 (FIG. 4).

Figure 2:
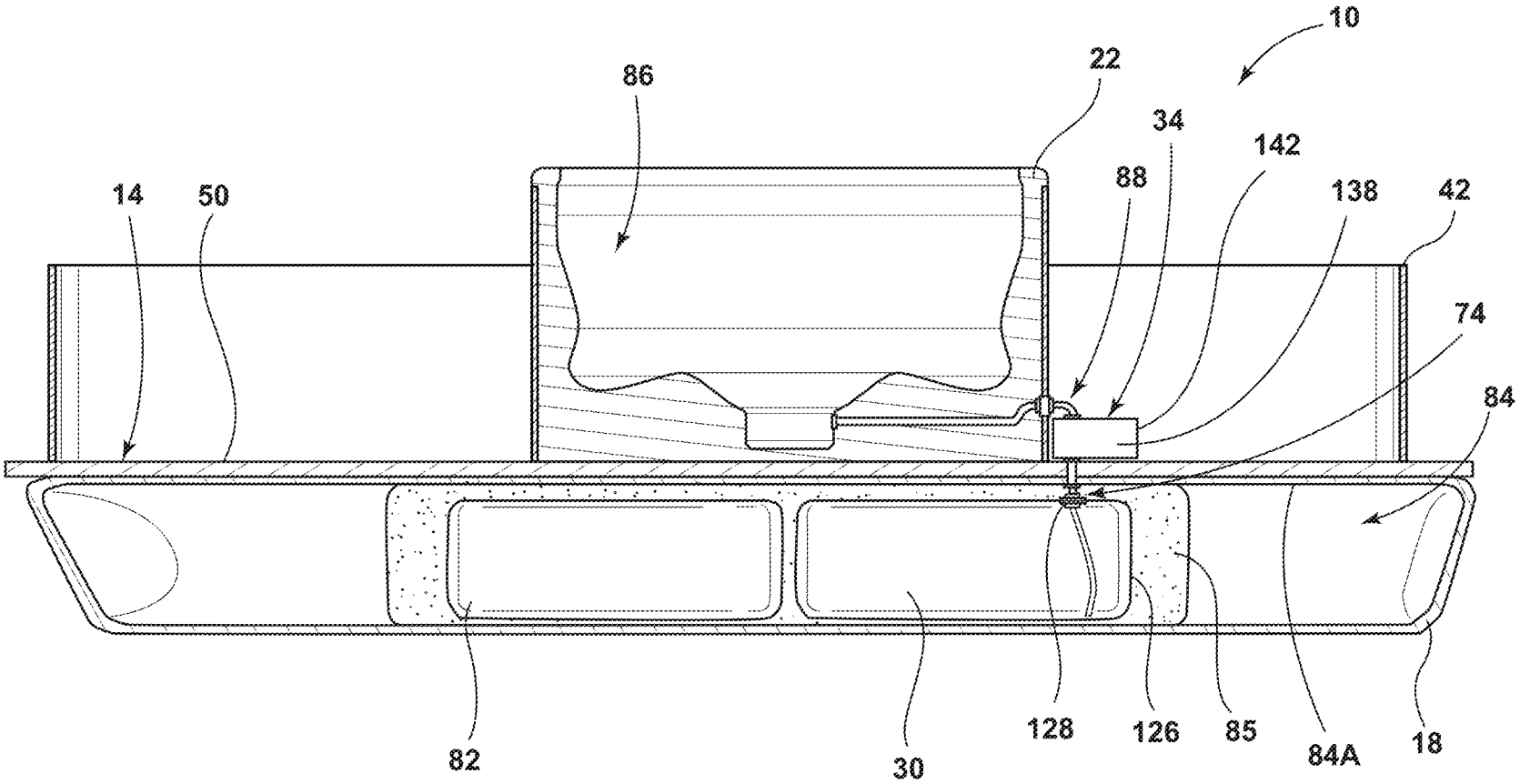
FIG. 2 is a cross-sectional view of the water vessel of FIG. 1A taken at line II.
Figure 3:
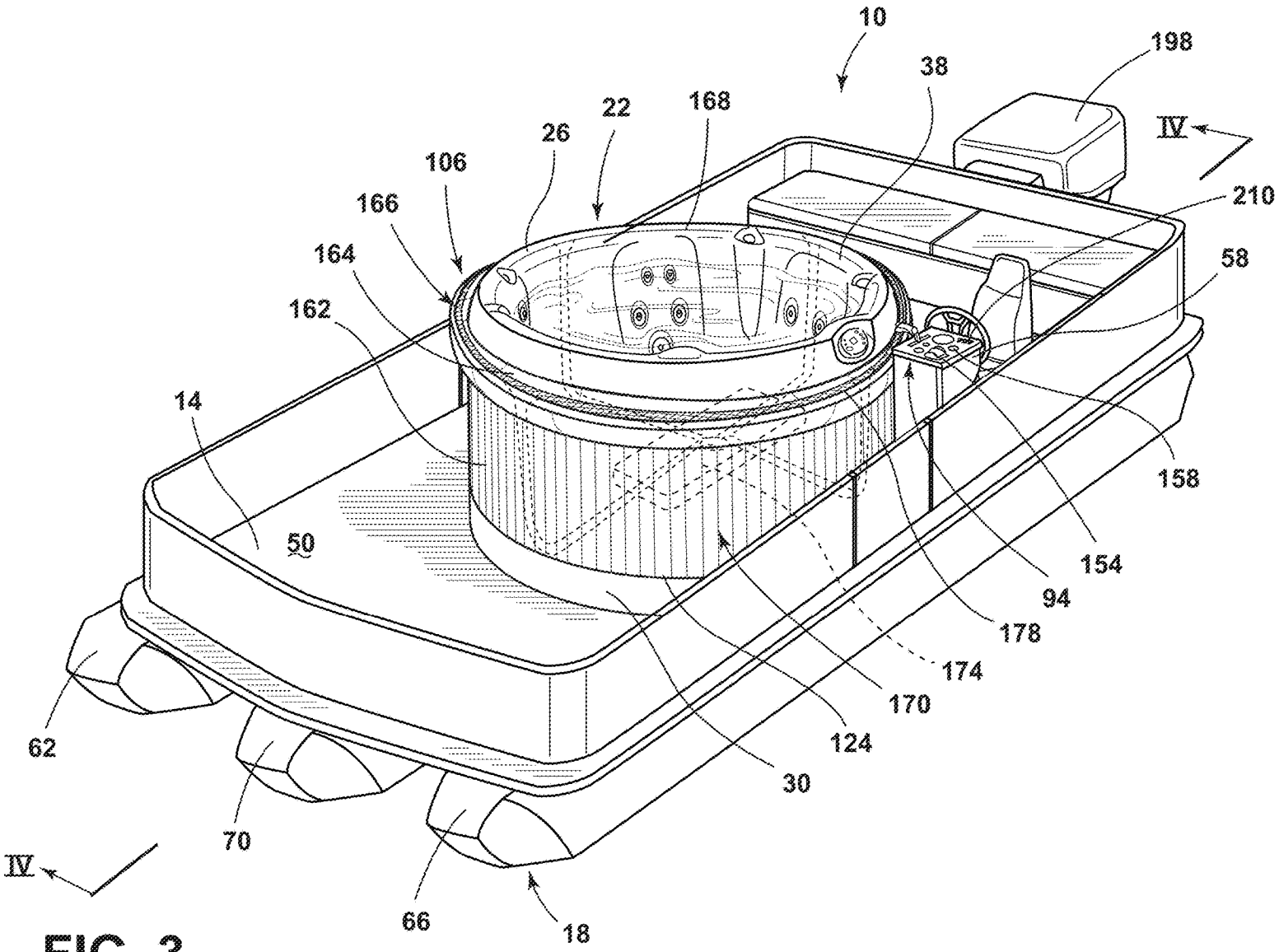
FIG. 3 is a front perspective view of a water vessel according to another embodiment.

Still referring to FIGS. 1A and 1B, the water system 22 can include the tub 26, the storage tank 30, the pump system 34 (FIG. 2), and a drain system 106 (FIG. 3). The tub 26 may be coupled to the top surface 50 of the deck 14. In various examples, the tub 26 may be positioned near the center portion 90 of the deck 14 and adjacent to the helm station 58. The tub 26 may be formed from a lightweight material such as, for example, plastic or fiberglass. In various examples, the tub 26 may be a hot tub configured to hold about 150 gallons to about 550 gallons of water. The tub 26 can be a circle, oval, triangle, square, rectangle, or any higher order polygon of a size where a substantial portion of a bottom surface 110 of the tub 26 is supported by the deck 14. As used herein, the term "supported by" means the tub 26 can be abuttedly supported on the top surface 50 of the deck 14 or the tub 26 can be received in a receiving aperture positioned on the deck 14, wherein the tub 26 can have portions thereof disposed either above or below the deck 14, or both. Further, the tub 26 can be supported by both the deck 14 and the closed hull structure 18, and a portion of the tub 26 can be received by the interior 84 of the closed hull structure 18. In various examples, at least one of the first, second, and/or third hulls 62, 66, 70 can be partially closed, allowing for the tub 26 to be at least partially received in the interior 84 of the closed hull structure 18. In such examples, the interior 84 of the closed hull structure 18 can be utilized as at least part of the tub 26. In a situation where the tub 26 is received in the interior 84 of the closed hull structure 18, connections to the storage tank 30 can be positioned within the closed hull structure 18.

In various examples, the tub 26 may include the jet system 98. The jet system 98 can include at least one jet 114 configured to direct water and/or air into the water within the interior 86 of the tub 26. The jet 114 can be movably coupled within the jet system 98, such that the jet 114 can be directed at multiple angles into the interior 86 of the tub 26. In various examples, the jet system 98 may be configured to be adjustable so the rate of fluid flowing through the jets 114 can be increased and/or decreased. The jet system 98 may be activated and/or deactivated by the controller 94. The controller 94 may be positioned at the helm station 58 and/or on an exterior surface 122 of the tub 26.

Referring to FIG. 2, in various examples, the storage tank 30 may be positioned within an interior 84 of the closed hull structure 18. In other words, the storage tank 30 may be positioned within and/or integrally formed to the interior 84 of at least one of the first, second, and third hulls 62, 66, 70 (FIG. 1). The storage tank 30 may include a single tank positioned within an interior of a single hull structure. In various examples, the water vessel 10 can include the first, second, and third hulls 62, 66, 70 (FIG. 1), and the storage tank 30 can be positioned within the centrally disposed third hull 70 to provide for improved stability of the water vessel 10. In various examples, the storage tank 30 may be positioned on the top surface 50 of the deck 14. The storage tank 30 can be positioned under the seating assembly 46 (FIG. 1) and/or in the gunwale 42 of the water vessel 10, such that the storage tank 30 may be configured to act as a ballast to assist with stability of the water vessel 10. In various examples, such as the example depicted in FIG. 3, the storage tank 30 can be coupled to the top surface 50 of the deck 14 and the tub 26 can be coupled to a top surface 124 of the storage tank 30, when the storage tank 30 is coupled to the top surface 50 of the deck 14, the storage tank 30 and/or the tub 26 may be removable, such that the storage tank 30 and/or tub 26 can be attached to additional water vessels 10.

Alternatively, the storage tank 30 may include a system having two or more storage tanks positioned in one or more closed hull structures 18, such that the weight of the stored water can be distributed between multiple tanks or within front and rear portions of a single tank to provide greater stability of the water vessel 10. In examples where the storage tank 30 includes the system having two or more storage tanks, the two or more storage tanks may have open communication with one another. In this way, the system can be self-equalizing, such that the water in the two or more storage tanks can be substantially equalized. This may be advantageous for providing increased stability for the water vessel 10. The self-equalization between the storage tanks 30 may also provide increased stability in rough waters by providing added ballast to the water vessel 10. Additionally or alternatively, weight of the storage tank 30 may be offset by additional storage tanks 30 included in the system. In additional or alternative examples, the weight of the storage tank 30 may be offset by the fuel tank 82. The storage tank 30 and the fuel tank 82 may be positioned in the first and second hulls 62, 66 to offset the weights of one another. In further additional or alternative examples, the storage tank 30 and/or the fuel tank 82 may be disposed in the centrally-disposed third hull 70 to provide center ballast to the water vessel 10.

According to various aspects, the interior 86 of the tub 26 may have a capacity configured to hold about 150 gallons to about 550 gallons of water. The storage tank 30 may have a capacity to hold between about 150 gallons to about 550 gallons of water. In this way, the water in the tub 26 may be substantially, or entirely, drained to the storage tank 30. According to various aspects, the capacity of the storage tank 30 may be less than the capacity of the interior 86 of the tub 26. The storage tank 30 may be operable between full and drained conditions. When in the full condition, the storage tank 30 may hold at least some of the water from the tub 26. When in the full condition, the storage tank 30 may have an increased weight. The storage tank 30 in the full condition may have a weight in a range of from about 550 kg to about 2100 kg depending on the capacity of the storage tank 30 and the water housed in the storage tank 30. The increased weight of the storage tank 30 may provide added ballast to the water vessel 10.

Referring again to FIG. 2, the storage tank 30 may be sealed and insulated, such that the water being removed from the tub 26 may retain heat for re-inserting the water into the tub 26. The outer surface 126 of the storage tank 30 can directly abut an interior surface 84A of the closed hull structure 18. The insulation material 85 may be disposed about the outer surface 126 of the storage tank 30. According to various examples, the storage tank 30 can be embedded within the insulation material 85. The insulation material 85 may be, for example, a foamed insulation material. Use of a foamed insulation material such as, for example, a polyurethane foam, can secure the storage tank 30 within the interior 84 of the closed hull structure 18 and thereby also increase stability of the water vessel 10. Additionally, use of the insulation material 85 can minimize heat loss of the water within the storage tank 30 and conserve energy. The insulation material 85 can be configured to act as a seal around the outer surface 126 of the storage tank 30. In various examples, the storage tank 30 can be formed from a metal or metal alloy such as, for example, stainless steel, and may be welded to internal features within a hull structure. A volume of the storage tank 30 may be dictated by the cross-sectional measurement of the closed hull structure 18 when the storage tank 30 is positioned within the interior 84 of the closed hull structure 18. In various examples, the storage tank 30 can hold about 100 gallons to about 150 gallons of water. It will be understood that the volume held by the storage tank 30 can be greater or lesser depending on the number and/or cross-sectional measurement of closed hull structure 18 in the water vessel 10.

Still referring to FIG. 2, the storage tank 30 may be fluidically coupled to the tub 26. The storage tank 30 can include a vent 128 that may be coupled to the pump system 34, where the pump system 34 is configured to move water between the storage tank 30 and the tub 26 via input and output through holes 130, 134 (FIG. 4), respectively, in the tub 26. The pump system 34 can include a first pump 138 and the tubing structure 88. The tubing structure 88 can couple the storage tank 30 to the tub 26, such that the tubing structure 88 extends between the storage tank 30 and the first pump 138 and between the first pump 138 and the tub 26. The pump system 34 may be a bi-direction pump system, such that it may introduce and remove water from the interior 86 of the tub 26 utilizing a single pump. In various examples, the pump system 34 includes a 12-volt 12-gallon per minute bi-directional pump positioned within a housing 142. The tubing structure 88 may include a first tubing 146 (FIG. 4) and a second tubing 150 (FIG. 4), where the first tubing 146 is configured to insert water into the tub 26 via the input through hole 130 (FIG. 4), as coupled thereto, and the second tubing 150 is configured to remove water from the tub 26 via the output through hole 134 (FIG. 4) as coupled thereto. The first and second tubings 146, 150 (FIG. 4) may have a diameter of about ¾-inch to about 1⅛-inch. The tubing structure 88 may extend from the first pump 138 through the deck 14 proximate the tub 26 and couple to the input and/or output through hole 130, 134 (FIG. 4). The tubing structure 88 may extend from the first pump 138 through the deck 14 and into the storage tank 30 via the access point 74. In various examples, the tubing structure 88 may be removably coupled to the tub 26, such that the pump system 34 can be disconnected from the tub 26 to allow for disposal of water within the tub 26 and/or the storage tank 30. The pump system 34 may provide a passenger with the ability to fluctuate a water level within the interior 86 of the tub 26 to accommodate varying number of occupants within the tub 26.

Referring now to FIGS. 2 and 3, the pump system 34 may be controlled by the controller 94 positioned on the helm station 58. In various examples, the controller 94 may include a ballast rocker switch 154 configured to activate the pump system 34. The ballast rocker switch 154 can communicate with the pump system 34 to control when the pump system 34 pumps water to the tub 26 from the storage tank 30, and when the pump system 34 pumps water from the tub 26 to the storage tank 30. The controller 94 may include a timer 158 operably coupled to the ballast rocker switch 154, such that the timer 158 controls when to activate and/or deactivate the ballast rocker switch 154 to prevent overfilling the tub 26.

In the example depicted in FIG. 3, the water system 22 includes a shell 162 having the drain system 106 operably coupled to at least one of the storage tank 30 and tub 26. The drain system 106 can provide for the shell 162 to have a top surface 164 with perforations 166 disposed therein, which allow water passing over a top edge portion 168 of the tub 26 to be collected for reuse. The overflow water may be collected and directed to the storage tank 30 positioned proximate the tub 26 via the drain system 106. In various examples, the overflow water may be guided to a cavity 170 defined by the shell 162 and/or collected into a storage bladder 174 via the drain system 106. The storage bladder 174 may be fluidically coupled to the storage tank 30 and/or the tub 26. The storage bladder 174 can be a rigid, self-supported structure, or alternatively, can be a conformable structure. The overflow water may be stored in the storage tank 30 and/or storage bladder 174 for a period of time. Alternatively, the overflow water may be immediately directed from the drain system 106 to the interior 86 of the tub 26 via the pump system 34 (FIG. 2). The top surface 164 of the shell 162 may include a splash guard 178 to prevent water from spilling over a sidewall 38 of the tub 26 onto the top surface 50 of the deck 14. In various examples, the top surface 164 of the shell 162 may be about 6-inches to about 12-inches wide. The top surface 164 of the shell 162 may extend at an angle from the top edge portion 168 of the tub 26, where the angle can be from about 45 degree to about 235 degrees.

The water vessel 10 can include a motor 198 operably coupled to the fuel tank 82 (FIG. 2). The motor 198 can be a suitable motor based on the size and/or weight of the water vessel 10 and may include a propeller. In various examples, the motor 198 may be controlled via the controller 94 on the helm station 58. The motor 198 can be, for example, an outboard engine and/or a sterndrive engine.

Referring to FIG. 4, the tub 26 may include a release valve 182 coupled to a drainage tube 186. The release valve 182 may be operable between opened and closed positions. When in the opened position, the release valve 182 may provide for draining of the tub 26 into the storage tank 30 and/or for disposal of the water. Draining of the tub 26 via the release valve 182 and drainage tube 186 may remove water from the interior 86 of the tub 26 at a quicker rate than removing water via the pump system 34. The drainage tube 186 may be moveable, such that the water being removed may be guided to varying locations such as, for example, the storage tank 30, the storage bladder 174, and/or a location external of the water vessel 10 (e.g., overboard). In various examples, the draining tube 186 can be a gravity-fed one-way drainage tube that removes the water from the tub 26 and inserts the water into the storage tank 30.

The tub 26 may include the heater 102 configured to heat the water in the interior 86 of the tub 26. In the depicted example, the heater 102 is coupled to the sidewall 38 of the tub 26. The heater 102 may be controlled from the controller 94 disposed on the tub 26 and can include a second pump 194, where the second pump 194 is configured to maintain and/or increase water temperature within the tub 26. The heater 102 can be, for example, a propane-powered on-demand power heater that utilizes a 12-volt pump. In other embodiments, the heater 102 can also be in thermal communication with the storage tank 30.

The water vessel 10 may include a battery 206 to power the pump system 34, the controller 94, and/or a stereo system 214 (FIG. 3). The battery 206 may be positioned within a casing 210 and coupled to the top surface 50 of the deck 14. The casing 210 may be a suitable size to accommodate more than one battery 206. According to various examples, the casing 210 may be defined by the seating assembly 46.

Referring still to FIG. 4, in operation, the pump system 34 allows passengers of the water vessel 10 to regulate the water level within the tub 26 positioned on the deck 14. Passengers can activate the pump system 34 using the ballast rocker switch 154 (FIG. 3) positioned at the helm station 58 (FIG. 3). The pump system 34 can draw water out of the storage tank 30 and insert the water into the interior 86 of the tub 26 via the input through hole 130. The ballast rocker switch 154 (FIG. 3) can include the timer 158 (FIG. 3), which can operate to deactivate the pump system 34 after a pre-programmed time has elapsed. If the water level within the tub 26 is higher than the passengers desire, the passengers can activate the pump system 34 via the ballast rocker switch 154 (FIG. 3), such that the pump system 34 removes water from the tub 26 via the output through hole 134. The water passes through the first tubing 146 to be re-inserted into the storage tank 30.

Use of the present disclosure allows a passenger on the water vessel 10 to predict and adjust water levels within the tub 26 accordingly. When in a first location in a body of water, the tub 26 can be filled with water such that the tub 26 can accommodate a first number of passengers of the water vessel 10 therein. As additional passengers enter the tub 26, the occupants can activate the pump system 34 to remove water from the tub 26 to accommodate the additional occupants and prevent an overflow of water. As occupants leave the tub 26, the occupants can activate the pump system 34 to introduce water into the tub 26 and thereby raise the water level within the tub 26.

Additionally, as the water vessel 10 prepares to move to a second location in the body of water, the passengers of the water vessel 10 can activate the pump system 34 to lower the water level within the tub 26. Lowering the water level can reduce the amount of water passing over the top edge portion 168 of the tub 26 as the water vessel 10 moves through open water. Further, moving the water from the tub 26 to the storage tank 30 may create a more centralized location of the water compared to the tub 26 and thereby increasing stability of the water vessel 10 through a more substantial centralized ballast. When the water vessel 10 arrives at the second location, the passengers can activate the pump system 34 to introduce water into the tub 26 to accommodate occupants therein.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It is also to be understood that variations and modifications can be made on the aforementioned structures and methods without departing from the concepts of the present device, and further it is to be understood that such concepts are intended to be covered by the following claims unless these claims, by their language, expressly state otherwise.

The above description is considered that of the illustrated embodiments only. Modifications of the device will occur to those skilled in the art and to those who make or use the device. Therefore, it is understood that the embodiments shown in the drawings and described above are merely for illustrative purposes and not intended to limit the scope of the device, which is defined by the following claims as interpreted according to the principles of patent law, including the Doctrine of Equivalents.

What is claimed is:

1. A water vessel, comprising:

a deck having an upper surface and a lower surface;

first and second hulls spaced-apart from one another and operably coupled to the lower surface of the deck, wherein at least one of the first and second hulls has an at least partially hollow interior;

a storage tank positioned within the at least partially hollow interior of at least one of the first and second hulls;

a tub for holding water supported by the deck, wherein the tub includes an interior cavity having a capacity and is fluidically coupled to the storage tank, and wherein the storage tank has a capacity less than the capacity of the tub;

a pump system configured to direct water between the tub and the storage tank and at least partially fill the capacity of the tub;

a drain system fluidically coupled to the tub and configured to remove water from the tub; and a storage bladder fluidically coupled to the drain system for collecting water removed from the tub by the drain system.

2. The water vessel of claim 1, including:

a helm station positioned on the deck adjacent to the tub and operable between first and second positions.

3. The water vessel of claim 2, including:

a seating assembly positioned on the deck, wherein a steering wheel of the helm station aligns with the seating assembly in the first position and the tub in the second position.

4. The water vessel of claim 1, including:

a shell positioned around the tub and fluidically coupled with at least one of the tub and the storage tank.

5. The water vessel of claim 4, wherein the shell defines perforations in fluidic communication with a cavity therein for collecting water.

6. The water vessel of claim 1, including:

a heater, wherein water is heated by the heater prior to insertion into the tub by the pump system.

7. A water vessel, comprising:

a closed hull structure;

a deck supported by the closed hull structure;

a tub for holding water supported by the deck;

a storage tank fluidically coupled to the tub;

a pump system fluidically coupled to the tub and the storage tank, wherein the pump system is configured to direct water between the tub and the storage tank, and wherein the pump system includes a tubing structure extending through an aperture defined in the deck and an access point defined in the closed hull structure; and a drain system fluidically coupled to the tub.

8. The water vessel of claim 7, wherein the access point is operable between closed and opened position, and wherein the access point is in the closed position when the pump system is disengaged from the tub.

9. The water vessel of claim 7, wherein the storage tank is positioned within an interior of the closed hull structure.

10. The water vessel of claim 9, including:

an insulation material, wherein the storage tank is embedded within the insulation material within the interior of the closed hull structure.

11. The water vessel of claim 7, wherein the pump system includes a bi-direction pump configured to insert and remove water from the tub and the storage tank.

12. The water vessel of claim 7, wherein the tub includes a release valve fluidically coupled to a drainage tube of the drain system.

13. The water vessel of claim 7, wherein the closed hull structure includes at least a first hull and a second hull.

14. A hot tub assembly, comprising:

a tub for holding water;

a bi-directional pump system fluidically coupled to the tub;

a storage tank coupled to the tub via the bi-directional pump system, wherein the bi-directional pump system is configured to direct water between an interior of the tub and the storage tank;

a shell positioned about a perimeter of the tub, wherein the shell includes a drain system operably coupled to at least one of the storage tank and the tub, and wherein the shell includes a plurality of perforations in fluid communication with the drain system; and a storage bladder fluidically coupled to the drain system, wherein water is directed from the perforations of the shell to the storage bladder via the drain system.

15. The hot tub assembly of claim 14, wherein the pump system includes a tubing structure and a heater, wherein the pump system directs water from the storage tank through the heater and into an interior of the tub via the tubing structure.

16. The water vessel of claim 1, wherein the storage tank is positioned on a top surface of the deck, and further wherein the tub is operably coupled to a top surface of the storage tank.

* * * * *